US011781469B2

(12) United States Patent
Heher et al.

(10) Patent No.: US 11,781,469 B2
(45) Date of Patent: Oct. 10, 2023

(54) INSERT DEVICE FOR FUEL INJECTION

(71) Applicant: Transportation IP Holdings, LLC, Norwalk, CT (US)

(72) Inventors: Brett Heher, Pittsburgh, PA (US); Adam Edgar Klingbeil, Ballston Lake, NY (US); Manuel Licon Flores, Erie, PA (US); Kevin Paul Bailey, Mercer, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 17/401,284

(22) Filed: Aug. 12, 2021

(65) Prior Publication Data

US 2023/0052578 A1 Feb. 16, 2023

(51) Int. Cl.
*F02B 23/06* (2006.01)
*F02B 23/02* (2006.01)
(Continued)

(52) U.S. Cl.
CPC ..... *F02B 23/02* (2013.01); *B01F 23/232* (2022.01); *B01F 25/3142* (2022.01); *B01F 2101/503* (2022.01)

(58) Field of Classification Search
CPC . F02B 23/0651; F02B 23/02; F02M 61/1853; B01F 25/3142; B01F 23/232; B01F 2101/503
See application file for complete search history.

(56) References Cited

U.S. PATENT DOCUMENTS 1,136,818 A 4/1915 Leissner
1,213,911 A 1/1917 Schmid
(Continued)

FOREIGN PATENT DOCUMENTS

DE 102004011169 A1 9/2005
DE 102018133036 A1 7/2019
(Continued)

OTHER PUBLICATIONS

Camillo "Best Practices for Press-Fit Assembly" AssemblyMag.com; Sep. 14, 2017 (4 pages).
(Continued)

*Primary Examiner* — Gonzalo Laguarda
(74) *Attorney, Agent, or Firm* — THE SMALL PATENT LAW GROUP LLC; Mary D. Lawlor

(57) ABSTRACT

An insert device includes a body having an upper body portion configured to couple with a cylinder head of an engine cylinder and a lower body portion extending from the upper body portion toward a combustion chamber of the engine cylinder. The body includes an interior surface extending around a central volume positioned to receive liquid fuel from a fuel injector. The body includes gas inlet channels and fuel-and-gas mixture outlet channels. The gas inlet channels direct gas into the central volume where the gas mixes with the liquid fuel to form the fuel-and-gas mixture. The fuel-and-gas mixture outlet channels direct the mixture into the combustion chamber. The interior surface includes concave surface portions between the inlet channels and the outlet channels along a center axis of the body that are shaped to direct the gas into the central volume toward the liquid fuel in the central volume.

17 Claims, 9 Drawing Sheets

(51) Int. Cl.

| | |
|---|---|
| ***B01F 23/232*** | (2022.01) |
| ***B01F 25/314*** | (2022.01) |
| *B01F 101/00* | (2022.01) |

(56) References Cited

U.S. PATENT DOCUMENTS

| | | | | |
|---|---|---|---|---|
| 1,260,408 | A | 3/1918 | Leissner | |
| 1,747,935 | A | 2/1930 | Hemmingsen | |
| 1,948,557 | A | 2/1934 | Baur | |
| 2,470,351 | A | 5/1949 | Hartridge | |
| 2,631,577 | A | 3/1953 | Carter | |
| 2,733,630 | A | 2/1956 | Saives | |
| 3,683,873 | A | 8/1972 | Tarter | |
| 3,785,628 | A | 1/1974 | Lang | |
| 4,112,906 | A | 9/1978 | Spencer | |
| 4,177,948 | A | 12/1979 | Schaffitz et al. | |
| 4,566,634 | A | 1/1986 | Wiegand | |
| 4,620,516 | A | 11/1986 | Reum et al. | |
| 5,024,193 | A | 1/1991 | Graze, Jr. | |
| 5,035,358 | A | 7/1991 | Katsuno et al. | |
| 5,067,467 | A | 11/1991 | Hill et al. | |
| 5,218,943 | A | 6/1993 | Takeda | |
| 5,315,973 | A | 5/1994 | Hill et al. | |
| 5,345,913 | A | 9/1994 | Belshaw et al. | |
| 5,772,122 | A * | 6/1998 | Sugiura | F02M 69/047 239/408 |
| 5,775,355 | A | 7/1998 | Maier et al. | |
| 6,095,437 | A * | 8/2000 | Nozawa | F02D 7/02 239/408 |
| 6,119,658 | A | 9/2000 | Jehle et al. | |
| 6,698,412 | B2 | 3/2004 | Dalla Betta | |
| 7,028,918 | B2 | 4/2006 | Bechanan et al. | |
| 7,210,448 | B2 | 5/2007 | Stanton et al. | |
| 7,213,564 | B2 | 5/2007 | Hill et al. | |
| 7,383,818 | B1 | 6/2008 | Beardmore | |
| 7,484,499 | B2 | 2/2009 | Beardmore | |
| 8,668,156 | B2 | 3/2014 | Lee et al. | |
| 8,950,176 | B2 | 2/2015 | Uzkan et al. | |
| 8,960,156 | B2 | 2/2015 | Martinsson et al. | |
| 9,243,580 | B2 | 1/2016 | Mariucci | |
| 9,429,127 | B2 | 8/2016 | Hongo et al. | |
| 9,506,439 | B2 | 11/2016 | Anders et al. | |
| 9,587,606 | B2 | 3/2017 | Anders et al. | |
| 9,797,351 | B2 | 10/2017 | Svensson et al. | |
| 9,803,538 | B2 | 10/2017 | Anders et al. | |
| 9,890,689 | B2 | 2/2018 | Hampson et al. | |
| 10,012,196 | B1 | 7/2018 | Qi et al. | |
| 10,036,355 | B2 | 7/2018 | Franks et al. | |
| 10,041,440 | B2 | 8/2018 | Di Pietro | |
| 10,072,606 | B2 | 9/2018 | Brunner | |
| 10,451,014 | B2 | 10/2019 | Ting et al. | |
| 10,711,752 | B2 | 7/2020 | Martin et al. | |
| 10,808,601 | B2 | 10/2020 | Hashizume | |
| 11,008,932 | B2 * | 5/2021 | Klingbeil | F02B 23/0651 |
| 2002/0002967 | A1 | 1/2002 | Paul et al. | |
| 2003/0155432 | A1 | 8/2003 | Buchanan et al. | |
| 2003/0196634 | A1 | 10/2003 | Lausch et al. | |
| 2009/0320774 | A1 | 12/2009 | Liebsch et al. | |
| 2010/0236533 | A1 | 9/2010 | Meldolesi et al. | |
| 2011/0067653 | A1 | 3/2011 | Clark et al. | |
| 2011/0068188 | A1 | 3/2011 | Laimboeck | |
| 2011/0126462 | A1 | 6/2011 | Livshits et al. | |
| 2011/0239751 | A1 | 10/2011 | Cueto | |
| 2012/0186555 | A1 | 7/2012 | Mueller | |
| 2014/0084085 | A1 | 3/2014 | Hongo et al. | |
| 2014/0150758 | A1 | 6/2014 | Zurlo et al. | |
| 2015/0211410 | A1 | 7/2015 | Saville et al. | |
| 2015/0211461 | A1 | 7/2015 | Shirk et al. | |
| 2015/0219051 | A1 | 8/2015 | Carpenter et al. | |
| 2016/0024994 | A1 | 1/2016 | Engineer | |
| 2016/0084411 | A1 | 3/2016 | Laws | |
| 2016/0097360 | A1 | 4/2016 | Mueller | |
| 2016/0245224 | A1 | 8/2016 | Ruona et al. | |
| 2016/0298528 | A1 | 10/2016 | Svensson | |
| 2016/0298529 | A1 | 10/2016 | Anders et al. | |
| 2016/0298584 | A1 | 10/2016 | Svensson | |
| 2016/0303672 | A1 | 10/2016 | Onley et al. | |
| 2016/0327000 | A1 | 11/2016 | John | |
| 2017/0009712 | A1 | 1/2017 | Svensson et al. | |
| 2017/0089310 | A1 | 3/2017 | Svensson | |
| 2017/0114763 | A1 | 4/2017 | Mueller | |
| 2018/0149125 | A1 | 5/2018 | Ting et al. | |
| 2018/0195430 | A1 | 7/2018 | Fitzgerald | |
| 2018/0202403 | A1 | 7/2018 | Huff | |
| 2019/0017464 | A1 | 1/2019 | Schlee | |
| 2019/0063391 | A1 | 2/2019 | Martin et al. | |
| 2019/0218959 | A1 * | 7/2019 | Klingbeil | F02B 23/0654 |
| 2020/0040857 | A1 | 2/2020 | Kurtz et al. | |
| 2020/0191045 | A1 * | 6/2020 | Gubba | F02B 23/0651 |

FOREIGN PATENT DOCUMENTS

| | | | |
|---|---|---|---|
| JP | 831250 | A | 11/1996 |
| JP | 2012125711 | A | 7/2012 |
| KR | 100665727 | B1 | 1/2007 |
| WO | 2007058103 | A1 | 5/2007 |
| WO | 2015187653 | A1 | 12/2015 |

OTHER PUBLICATIONS

O'Connor et al., "Post Injections for Soot Reduction in Diesel Engines: A Review of Current Understanding", SAE Int. J. Engines, vol. 06, Issue: 01, pp. 400-421, 2013.

O'Connor et al., "Effect of Load on Close Coupled Post-Injection Efficacy for Soot Reduction in an Optical Heavy-Duty Diesel Research Engine", J. Eng. Gas Turbines Power, vol. 136, Issue: 10, pp. 16, May 2, 2014.

Office Action dated Aug. 21, 2020 for corresponding DE Application No. 10 2018 133 036.7 (12 pages).

First Examination Report dated Mar. 3, 2022 for corresponding Australian Patent Application No. 2021201025 (4 pages).

First Office Action dated Nov. 3, 2022 for Chinese Application No. 2021102128391 (14 pages).

English translation of the First Office Action dated Nov. 3, 2022 for Chinese Application No. 2021102128391 (17 pages).

Examination Report dated Nov. 22, 2022 for corresponding German Application No. 102021103946.0 (36 pages) Machine English translation provided.

Examination Report dated Jun. 2, 2023 for corresponding Australian Application No. 2022201015 (5 pages).

* cited by examiner

INSERT DEVICE FOR FUEL INJECTION

GOVERNMENT LICENSE RIGHTS

This invention was made with government support under Cooperative Agreement DEEE0009199 awarded by the Office of Energy Efficiency and Renewable Energy. The government has certain rights in the invention.

BACKGROUND

Technical Field

The subject matter described herein relates to devices and methods for mixing fuel and a gas into a fuel-and-gas mixture prior to injection of the mixture into engine cylinders.

Discussion of Art

In a compression ignition engine, fuel may be directly injected into compressed hot gases, such as air or a mixture of air and recycled exhaust gas. The fuel mixes with these in-cylinder gases near the site of injection of the fuel into the cylinders of the engine. As the relatively cool fuel mixes with the higher temperature gases, the resulting mixture reaches a temperature sufficient for ignition. This may be a dynamic event and fuel may be ignited and may burn at the head of a fuel spray plume while fuel continues to be injected into the other end of the spray plume.

As the temperature of the gases entrained into the injected fuel remains elevated, the delay between injection of the fuel and ignition of the fuel-and-air mixture in a cylinder may be reduced. This may cause the fuel spray plume to have a sub-optimal fuel-and-air mix ratio before initial ignition, which may produce soot. The production and consequential build-up of soot may degrade performance of the engine and eventually require cleaning or other repair of the engine. Additionally, certain regulations or laws may restrict how much particulate matter or other emissions can be generated by engines.

Insert devices may be placed between fuel injectors and combustion chambers of engine cylinders to mix fuel and air before the mixture of fuel and air is directed into the combustion chambers. These insert devices can be exposed to extreme temperatures, which can introduce mechanical stress to the insert devices due to these devices having different coefficients of thermal expansion (CTE) than the cylinder heads to which the insert devices are coupled. This stress can damage or destroy the insert devices and/or cylinder heads.

The insert devices may include conduits through which gas and fuel is received. It may be necessary to control characteristics of the gas and/or fuel within the insert devices, and the flow of the fuel-and-gas mixture into the engine cylinders. Therefore, a need exists for insert devices that enable the control of the fluids that move toward, within, and out of these insert devices.

BRIEF DESCRIPTION

In one or more embodiments, an insert device includes a body having an upper body portion configured to couple with a cylinder head of an engine cylinder and a lower body portion extending from the upper body portion toward a combustion chamber of the engine cylinder while the upper body portion is coupled with the cylinder head. The body includes an interior surface extending around a central volume positioned to receive liquid fuel from a fuel injector while the upper body portion is coupled with the cylinder head. The body includes gas inlet channels and fuel-and-gas mixture outlet channels. The gas inlet channels are positioned to receive gas from outside the body and direct the gas into the central volume where the gas mixes with the liquid fuel to form the fuel-and-gas mixture. The fuel-and-gas mixture outlet channels are positioned to direct the fuel-and-gas mixture into the combustion chamber of the engine cylinder while the upper body portion is coupled with the cylinder head. The interior surface of the body includes concave surface portions between the gas inlet channels and the fuel-and-gas mixture outlet channels along a center axis of the body. The concave surface portions are shaped to direct flow of the gas into the central volume toward the liquid fuel in the central volume.

In one or more embodiments, an insert device includes a body having an upper body portion configured to couple with a cylinder head of an engine cylinder and a lower body portion extending from the upper body portion toward a combustion chamber of the engine cylinder while the upper body portion is coupled with the cylinder head. The body includes an interior surface extending around a central volume positioned to receive liquid fuel from a fuel injector while the upper body portion is coupled with the cylinder head. The body includes fuel-and-gas mixture outlet channels, an upper set of gas inlet channels, and a lower set of gas inlet channels. The upper and lower sets of the gas inlet channels are positioned to receive gas from outside the body and direct the gas into the central volume where the gas mixes with the liquid fuel to form a fuel-and-gas mixture. The fuel and gas mixture outlet channels are positioned to direct the fuel-and-gas mixture into the combustion chamber of the engine cylinder while the upper body portion is coupled with the cylinder head. The interior surface of the body includes concave dimples between the fuel-and-gas mixture outlet channels and one or more of the upper set or lower set of the gas inlet channels. The concave dimples are shaped to direct flow of the gas into the central volume toward the liquid fuel in the central volume.

In one or more embodiments, a method includes depositing a first layer onto a build surface, and sequentially depositing one or more additional layers upon the first layer to form an additively manufactured body having an upper body portion configured to couple with a cylinder head of an engine cylinder and a lower body portion extending from the upper body portion toward a combustion chamber of the engine cylinder while the upper body portion is coupled with the cylinder head. The body is formed to have an interior surface extending around a central volume positioned to receive liquid fuel from a fuel injector while the upper body portion is coupled with the cylinder head. The body is formed to have gas inlet channels and fuel-and-gas mixture outlet channels. The gas inlet channels are positioned to receive gas from outside the body and direct the gas into the central volume where the gas mixed with the liquid fuel to form a fuel-and-gas mixture. The fuel-and-gas mixture outlet channels are positioned to direct the fuel-and-gas mixture into the combustion chamber of the engine cylinder while the upper body portion is coupled with the cylinder head. The interior surface of the body is formed to have concave surface portions between the gas inlet channels and the fuel-and-gas mixture outlet channels along a center axis of the body. The concave surface portions are shaped to direct flow of the gas into the central volume toward the liquid fuel in the central volume.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
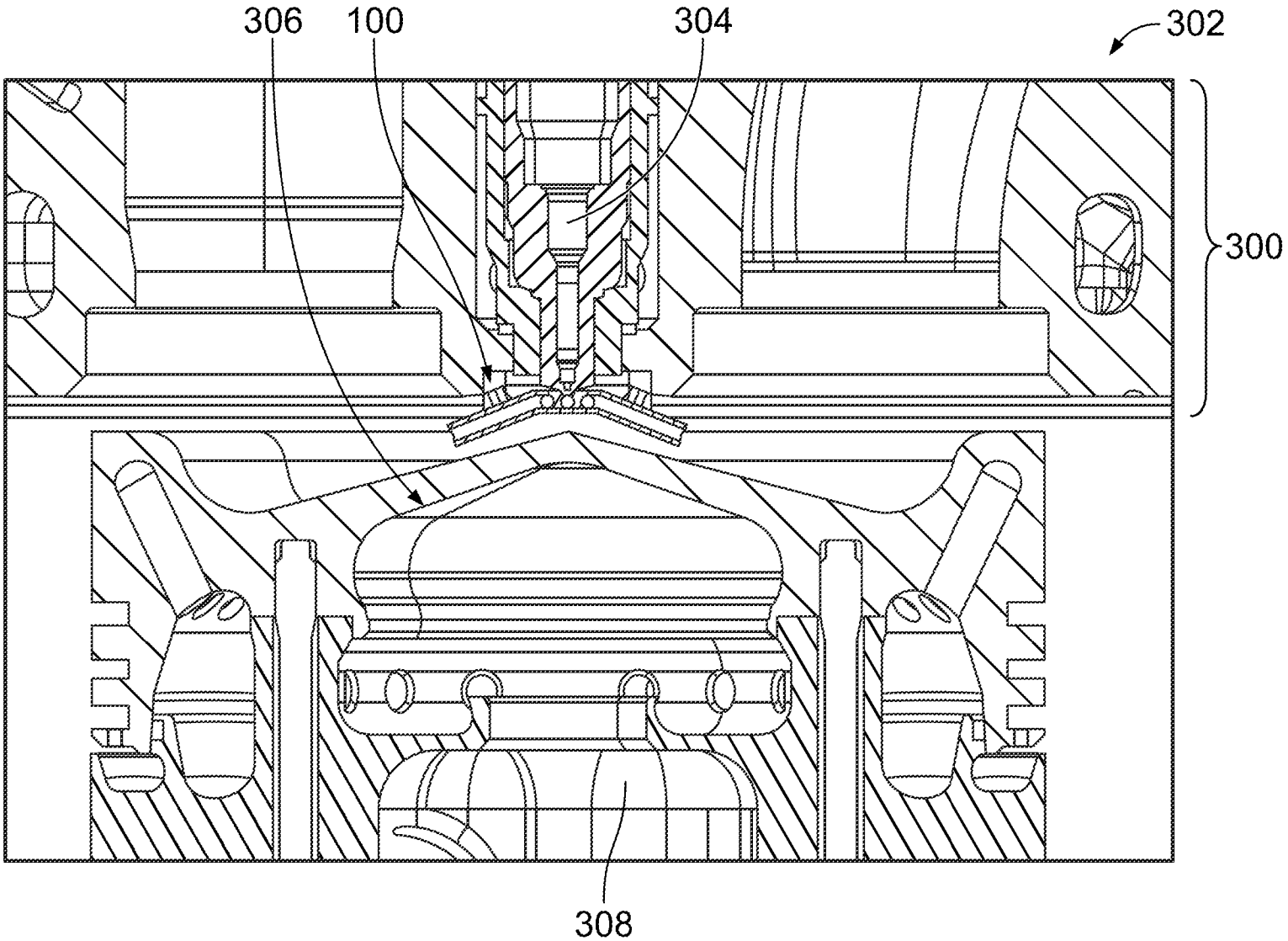
FIG. 1 illustrates a cross-sectional view of one example of an insert device coupled to a cylinder head of an engine cylinder in an engine.

Embodiments of the subject matter described herein relate to insert devices and methods that mix fuel and gas (e.g., air) into a fuel-and-gas (or fuel-and-air) mixture that is then directed into engine cylinders. The insert devices may include an upper body portion that couples with a cylinder head of an engine, and a lower body portion that extends from the upper body portion toward a combustion chamber of the engine cylinder. The insert devices include interior surfaces extending around and defining a central volume that receives liquid fuel from a fuel injector and gas from one or more gas inlet channels. The gas combines or mixes with the liquid fuel within the central volume, and is directed out of the central volume toward the combustion chamber via one or more fuel-and-gas mixture outlet channels. The interior surfaces of the insert devices may include one or more features (e.g., concave surface features, protrusions, extensions, angular surfaces, or the like) that may be configured to control or change one or more characteristics of the gas, the liquid fuel, and/or the fuel-and-gas mixture within the devices. For example, the one or more features may control or change a pressure, a volumetric flow rate, rotational forces, an amount, a level of turbulence, or the like, of one or more of the fluids within the insert devices.

The insert devices may affect and/or control an ignition delay of the fuel (e.g., by delaying the ignition relative to the time of injection). Ignition control may allow for a different (e.g., leaner) fuel-and-air mixture to be achieved prior to the mixture arriving at a region of combustion to ignite or combust. Several concepts are described herein that facilitate this modification of the fuel combustion event. Although tubes and ducts may be used in some assemblies, other insert devices define channels, flow paths, conduits, and the like and do not include a tube structure nor include a duct structure within the combustion chamber of a cylinder. Some devices having tubes or ducts have been shown to suffer from catastrophic failures, such as explosions occurring within the tubes.

With reference to some of such concepts, the insert devices may be placed in cylinder heads between fuel injectors and pistons inside engine cylinders, or may be disposed on top of the pistons. The insert devices may control (e.g., reduce) an amount of hot gas that is entrained into an injected fuel stream. A fuel injector may inject the fuel and may have a nozzle that forms a plurality of fuel streams. By adding in these insert devices, the fuel and air may have more time to mix prior to igniting in the engine cylinders. Additionally, the ratio of fuel to gas/air may be controlled, which may reduce or eliminate the production of certain exhaust products (e.g., soot, NOx) during the combustion process. The inventive insert devices described herein also can be referred to as mixing structures or mixing assemblies.

By adding these insert devices to engines, the devices may contact the hot gas and air to act as a heat sink. In this way, the insert devices may locally cool the previously hot gas/air as the gas/air is incorporated into, entrained, and/or swept along with a fuel stream plume inside the insert devices. The insert devices may cool the gases that may be entrained into fuel streams injected into the cylinders. A cooler mixture may delay ignition and thereby reduce an amount of soot generated or prevent generation of soot altogether. Various embodiments of the insert devices may be referred to as a soot reduction assembly or an engine assembly. As used herein, the terms gas or gases are inclusive of air, a combination of air and recycled exhaust gas (EGR), a combination of air and other diluents (e.g., water vapor, CO2, and/or N2, etc.), air modified to change the oxygen concentration, and a combination of any of the foregoing with aspirated natural gas.

As described herein, various embodiments of the insert devices include features or designs that reduce or eliminate mechanical stress caused by the elevated temperatures to which the insert devices are exposed. Reducing these stresses can increase the useful lives of the insert devices and/or cylinder heads.

The insert device can be additively manufactured using three-dimensional printing, direct metal laser sintering, or the like. The insert device can be formed from the same material or a combination of materials. The insert device can be a homogenous body having a consistent formulation and density throughout all of the device body. For example, the relative amounts of or ratio of weights, volumes, or both weights and volumes of materials used to form the insert device can be the same throughout all of the insert device, regardless of the size or shape of any part of the insert device. Alternatively, the insert device can be a non-homogenous body with the relative amounts of or ratio of weights, volumes, or both weights and volumes of materials differs in different locations of the insert device. The insert device may be monolithic in that the insert device is formed as a single piece body and is not created by forming separate parts that are later joined together to form the insert device. The bodies of the monolithic insert device can be integrally formed with each other as a single body. The monolithic aspect or nature of the insert device can be identified or verified by an absence of any seams or interfaces between different parts that are joined together to form the insert device. Alternatively, the insert device may not be a monolithic body in that the insert device is formed as several separate pieces that are later joined together to form the insert device. The non-monolithic aspect or nature of the insert device can be identified or verified by seams or interfaces between different parts that are joined together to form the insert device.

The additive manufacturing process for forming the insert device can involve sequentially constructing the device body layer by layer. For example, the insert device may be formed by depositing a first layer onto a build surface, and sequentially depositing one or more additional layers upon the first layer to form the additively manufactured insert device. Suitable processes include, for example, selective laser melting (or sintering) and binder jetting. Selective laser melting involves depositing a layer of powder on a build plate and fusing selective portions of the power using a ytterbium fiber laser that scans a computer aided design (CAD) pattern or file. Binder jetting creates a part by intercalating metal powder and polymer binding agent that bind the particles and layers together without the use of laser heating.

Different portions of the insert device can be additively manufactured from different materials. For example, the portion of the insert device that abuts or contacts the cylinder head of an engine cylinder may be formed from a first material (e.g., metal or metal alloy, polymer, ceramic, etc.) having a CTE that is the same as or closer to the CTE of the cylinder head, while another portion of the insert device that does not abut or contact the cylinder head may be formed from another material having a CTE that is different from or farther from the CTE of the cylinder head (farther from the CTE of the cylinder head than the portion of the insert device that contacts the cylinder head).

FIG. 1 illustrates a cross-sectional view of one example of an insert device 100 coupled to a cylinder head 300 of an engine cylinder 302 in an engine. The insert device may be coupled to the cylinder head in a location between a fuel injector 304 and a crown 306 of a piston 308 in the cylinder. The piston moves toward and away from the fuel injector during operation of the engine, or up and down in the perspective of FIG. 1. In the illustrated embodiment, the insert device may be stationary as the mixing structure may be mounted or otherwise affixed to the cylinder head. The piston moves toward and away from both the fuel injector and the stationary insert device. In one embodiment, the insert device may be affixed or otherwise coupled to, or incorporated into the crown of the piston such that the insert device moves with the piston toward and away from the fuel injector.

In operation, the fuel injector injects one or more streams of fuel into the central volume of the body of the insert device. During operation, the fuel streams flow from the fuel injector through a central volume of the insert device. The pressure supplied to the fuel injector may cause all or substantially all (e.g., at least 90%) of the fuel to pass through conduits of the insert device (after mixing with gases, as described herein).

As the fuel flows into the internal volume of the insert device, the moving fuel draws gases through air passages in the device (e.g., an opening along the top of the insert device, such as the side of the insert device that faces away from the piston and generally in a direction toward the fuel injector; openings above the fuel passages; openings below the fuel passages; etc.). The gases, which may be relatively hot, may be pulled through the interior of the insert device such that the hot gases move inward from outside the insert device into a center volume of the insert device.

The insert device may cool the incoming air by operating as a heat sink and/or increasing the dwell time of the air (e.g., the duration of time over which the air flows through the insert device, mixes with fuel, and enters the engine cylinder). The at least partially cooled gases then become entrained in the flow of fuel in the insert device to form a fuel-and-gas mixture inside the insert device. This fuel-and-gas mixture may be formed before the fuel or gas enters the combustion chamber of the cylinder. The fuel and gas mixes to form the fuel-and-gas mixture, which flows out of the insert device via one or more mixture conduits. The fuel-and-gas mixture then flows into the combustion chamber of the cylinder. This fuel-and-gas mixture may be cooler than fuel-and-gas mixtures that do not flow through or mix within the insert device, which may delay ignition inside the chamber of the cylinder and prevent or reduce soot formation, as described herein.

Optionally, the conduits may be oriented to direct the fuel-and-gas mixture farther into the combustion chamber of the cylinder such that the fuel-and-gas mixture penetrates further into the combustion chamber (e.g., compared to directing the fuel and gas into the combustion chamber without mixing the fuel and gas using the insert device. For example, mixing the fuel and gas in the insert device and then directing the fuel-and-gas mixture into the combustion chamber using the insert device may change the combination of mass and velocity of the mixture jet relative to the mass and velocity that the fuel and gas jet would separately have without pre-mixing the fuel and gas in the insert device. For example, the jet with the mixing structure may be more confined (e.g., narrower) than the jet would be without the insert device. Additionally, the jet may have lower initial mass entrainment but higher velocity relative to the jet without the insert device. Without the insert device, the jet could entrain more gases earlier in the flow path, which would have a high mass within the domain of the spray and spreading the spray resulting in a lower velocity and lower penetration into the cylinder. The more concentrated, higher velocity of the mixture by the insert device causes the mixture to enter farther into the combustion chamber to locations that may be farther from the insert device (relative to not using the insert device). As the penetration of the mixture into the combustion chamber increases, soot oxidation within the combustion chamber may be enhanced, which may eliminate or reduce the amount of soot in the engine cylinder.

Figure 2:
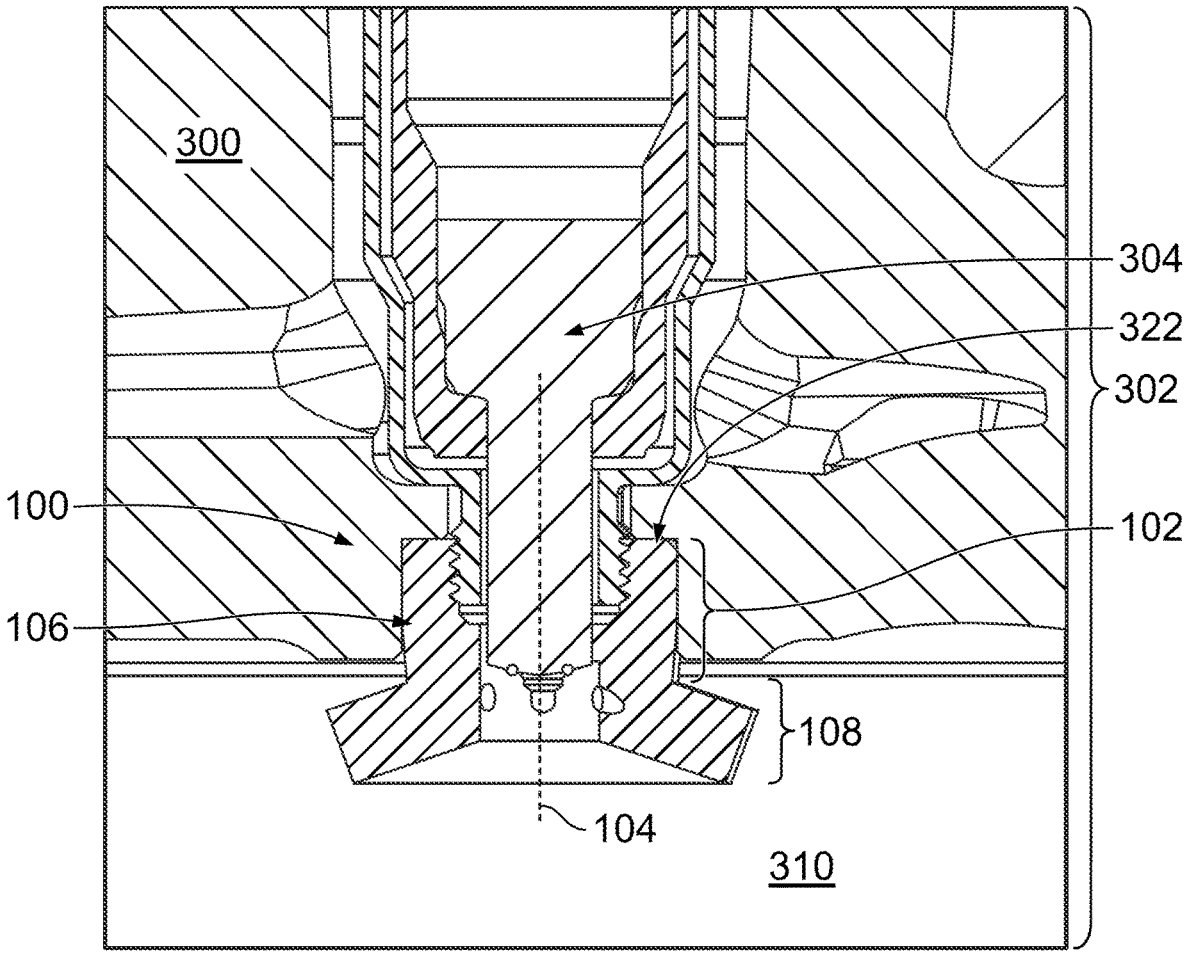
FIG. 2 illustrates a magnified cross-sectional view of one example of the insert device shown in FIG. 1.

FIG. 2 illustrates a magnified cross-sectional view of one example of the insert device 100 shown in FIG. 1. The inset device has a body 106 that includes an upper body portion 102 and a lower body portion 108 extending from the upper body portion toward the combustion chamber of the engine cylinder. The upper body portion is coupled with the cylinder head and receives the fuel injector. The lower body portion is fluidly coupled with the combustion chamber. In one or more embodiments, the upper body portion has a substantially circular cross-sectional shape, and the lower body portion has a substantially circular cross-sectional shape that is larger than the upper body portion. In one embodiment, the upper body portion may be concentric and/or coaxial with the lower body portion. Optionally, the upper and/or lower body portions of the body may have an alternative cross-sectional shape, size, or orientation relative to the other of the upper or lower body portions. The body of the insert device extends along a center axis 104 between the upper body portion and the lower body portion of the body. The upper body portion includes an upper end 322 that is positioned to face away from the combustion chamber while the upper body portion is coupled with the cylinder head. For example, the upper end faces away from the lower body portion of the body. The upper end may represent an exterior surface along a top side of the insert device.

Figure 3:
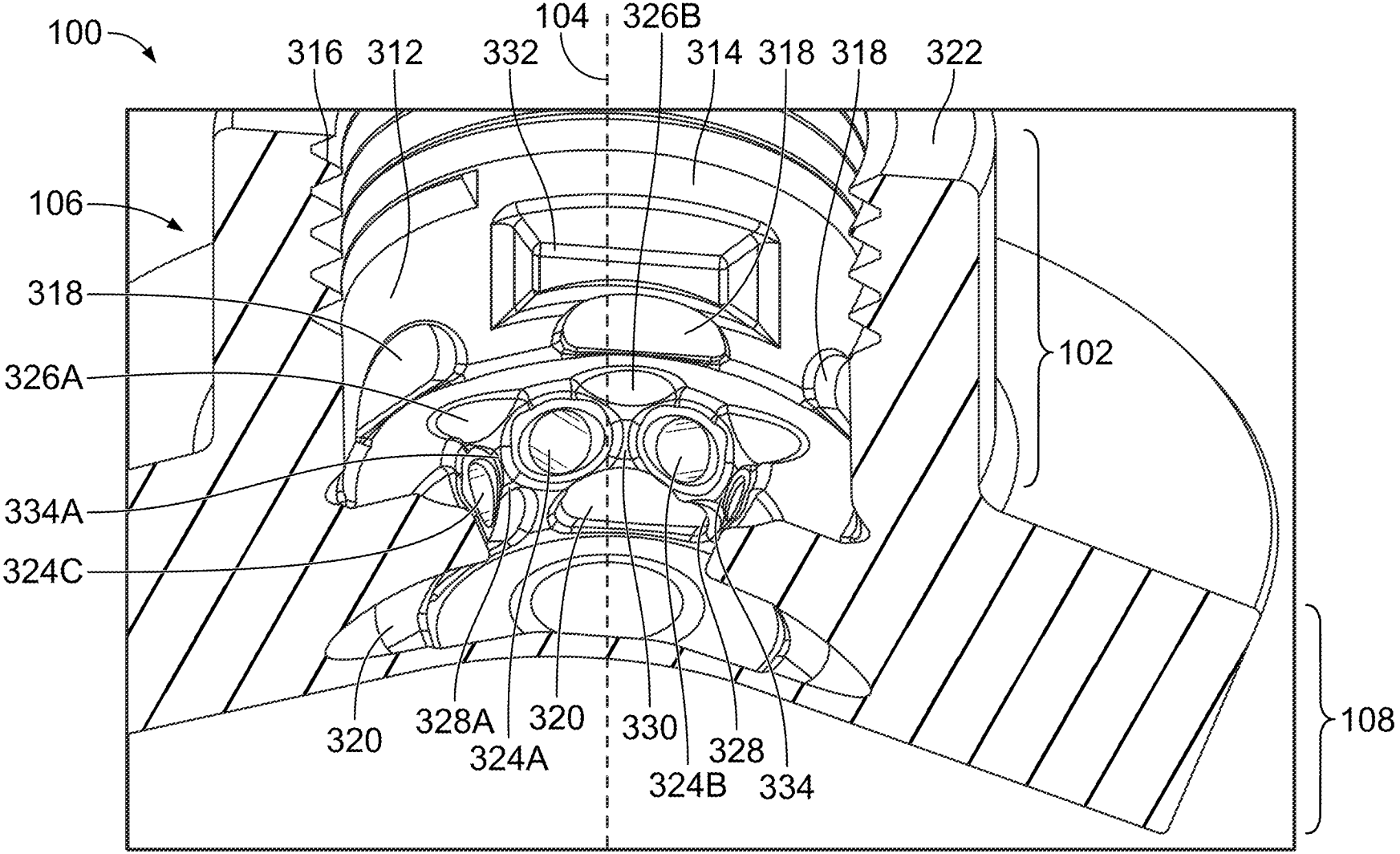
FIG. 3 illustrates a cross-sectional view the insert device shown in FIG. 2.

FIG. 3 illustrates a partial cross-sectional view of the insert device shown in FIG. 2. The body includes an interior surface 312 that extends around a central volume 314 of the insert device. The central volume is shaped and positioned to receive liquid fuel from the fuel injector (shown in FIG. 2) while the upper body portion is coupled with the cylinder head. In one embodiment, the upper body portion may include internal threads 316 that are disposed along a portion of the interior surface of the body. The internal threads may correspond to threads of the fuel injector and may couple the insert device with the fuel injector, or may couple the insert device with another portion of the cylinder head of the engine cylinder. Additionally, the body includes a coupling feature 332 that may mate or couple with a corresponding coupling feature of the fuel injector. For example, in the illustrated embodiment, the coupling feature protrudes away from the interior surface of the body toward the center axis. The fuel injector may include a coupling pocket or receiving pocket that may receive the coupling feature therein. Optionally, the insert device may be coupled with the cylinder head by any alternative mating and/or coupling features such as, but not limited to, press-fits, snap features, alignment components, or the like.

The insert device includes plural gas inlet channels 318, 320 that receive gas from outside of the body. For example, the gas inlet channels are channels, conduits, passages, or the like, that direct gas into the central volume of the insert device. The gas received within the central volume of the body mixes with the liquid fuel received from the fuel injector to form a fuel-and-gas mixture. The insert device also includes fuel-and-gas mixture outlet channels 324 to direct the fuel-and-gas mixture out of the central volume towards the combustion chamber of the engine cylinder.

In the illustrated embodiment shown in FIG. 3, the insert device includes an upper set 318 of the gas inlet channels and a lower set 320 of the gas inlet channels. The upper set of the gas inlet channels may include plural inlet channels disposed about the center axis of the body. The lower set of the gas inlet channels may include the same number or a different number of inlet channels as the upper set. Additionally, the lower set may include plural inlet channels disposed about the center axis. In one or more embodiments, the upper set of gas inlet channels may have a shape, size, and/or orientation that are the same or different than the shape, size, and/or orientation of the lower set of gas inlet channels. For example, the upper set may have a size that is different than a size of the lower set to control an amount of gas that is directed into the central volume of the body via the upper set relative to an amount of gas directed into the central volume via the lower set. Optionally, the upper set may have an orientation such that the upper set of gas inlet channels directs the gas toward the central volume in a first radial direction relative to the center axis, and the lower set may have an orientation such that the lower set directs the gas toward the central volume in a different, second radial direction relative to the center axis. Optionally, the upper and lower sets may direct the gas into the central volume in substantially the same or similar radial directions (e.g., within about 2° difference, about 5° difference, about 15° difference, or the like).

The upper set of the gas inlet channels are disposed within the upper body portion of the insert device and the lower set of the gas inlet channels are disposed within the lower body portion of the insert device. Optionally, one or both sets may be disposed within the upper or lower body portions of the insert device. The upper set of the gas inlet channels are disposed between the upper end 322 of the upper body portion and the fuel-and-gas mixture outlet channels along the center axis. The fuel-and-gas mixture outlet channels are disposed between the upper and lower sets of the gas inlets channels along the center axis.

In the illustrated embodiment of FIG. 3, the fuel-and-gas mixture outlet channels have a cross-sectional size that is smaller than a cross-sectional size of the gas inlet channels. For example, the fuel-and-gas mixture outlet channels may be shaped and sized to control one or more flow characteristics (e.g., pressure, velocity, turbulence, volume, direction of flow, or the like) of the fuel-and-gas mixture that is directed out of the central volume of the body via the outlet channels. The fuel-and-gas mixture outlet channels have a substantially circular cross-sectional shape, but alternatively may have any alternative shape to control flow characteristics of the mixture.

The insert device includes plural different concave surface portions or concave dimples that are disposed at locations along the interior surface of the body. The concave surface portions may protrude or extend into the interior surface of the body, such as to form depressions, divots, indents, dimples, recesses, or the like, along the interior surface. The concave surface portions may be shaped, sized, and/or positioned within the body to control flow characteristics of the gas, the liquid fuel, and/or the fuel-and-gas mixture. For example, the concave surface portions may be shaped, sized, oriented, or the like, to direct flow of the gas into the central volume of the body toward the liquid fuel in the central volume to mix with the liquid fuel to form the fuel-and-gas mixture. Optionally, the concave surface portions may be shaped, sized, oriented, or the like, to direct the fuel-and-gas mixture out of the insert device.

In the illustrated embodiment of FIG. 3, the insert device includes an upper set 326 of the concave surface portions or dimples, and a lower set 328 of the concave surface portions or dimples. The upper set of the concave surface portions are positioned between the upper set of the gas inlet channels and the fuel-and-gas mixture outlet channels along the center axis, and the lower set of the concave surface portions are positioned between the lower set of the gas inlet channels and the fuel-and-gas mixture outlet channels along the center axis. For example, the upper set of the concave surface portions are disposed above the fuel-and-gas mixture outlet channels and the lower set of the concave surface portions are disposed below the fuel-and-gas mixture outlet channels along the center axis.

The upper set and/or the lower set of the concave surface portions may be positioned between neighboring channels of the fuel-and-gas mixture outlet channels. For example, the upper set of the concave surface portions may include a first concave portion 326A and a second concave portion 326B. The first and second concave portions 326A, 326B are located between neighboring channels of the outlet channels about the center axis. For example, the second concave portion 326B is disposed between a first outlet channel 324A and a second outlet channel 324B of the fuel-and-gas mixture outlet channels. Additionally, neighboring concave surface portions may intersect with each other. In the illustrated embodiment, the first concave portion 326A of the upper set may intersect with the neighboring second concave portion 326B of the upper set about the center axis. For example, a portion of the recess, depression, or the like, of the first concave portion may intersect with, be coupled or merge with, or the like, a portion of the recess of the second concave portion.

In one or more embodiments, the concave surface portions may include an intermediate set 334 of concave surface portions. Each of the portions within the intermediate set may be located between neighboring channels of the fuel-and-gas mixture outlet channels. For example, a first surface 334A of the intermediate set of concave portions is disposed between the first outlet channel 324A and a third outlet channel 324C of the fuel-and-gas mixture outlet channels. Optionally, the concave portions in the intermediate set may merge with one or both of the upper set or lower set of the concave surface portions in locations 330 between neighboring channels of the fuel-and-gas mixture outlet channel. For example, the first surface 334A of the intermediate set may merge, combine with, be shaped similarly, or the like, with the first concave portion 326A of the upper set. Additionally or alternatively, the first surface of the intermediate set may merge, combine with, be shaped similarly, or the like, with a first concave portion 328A of the lower set of the concave surface portions.

In one or more embodiments, the body of the insert device may include plural layers of material coupled together to form the body. For example, a portion or all of the insert device can be additively manufactured using three-dimensional printing, direct material laser sintering, or the like. For example, the insert device may be a unitary body or unitary structure. The insert device may be formed from the same material or a combination of materials. Optionally, secondary forming or processing may be performed on a portion of the insert device. For example, the body may be additively formed as a unitary structure, and one or more of the inlets, outlets, concave portions, or the like, may subsequently formed (e.g., drilled, machined, etched, or the like).

Figure 4:
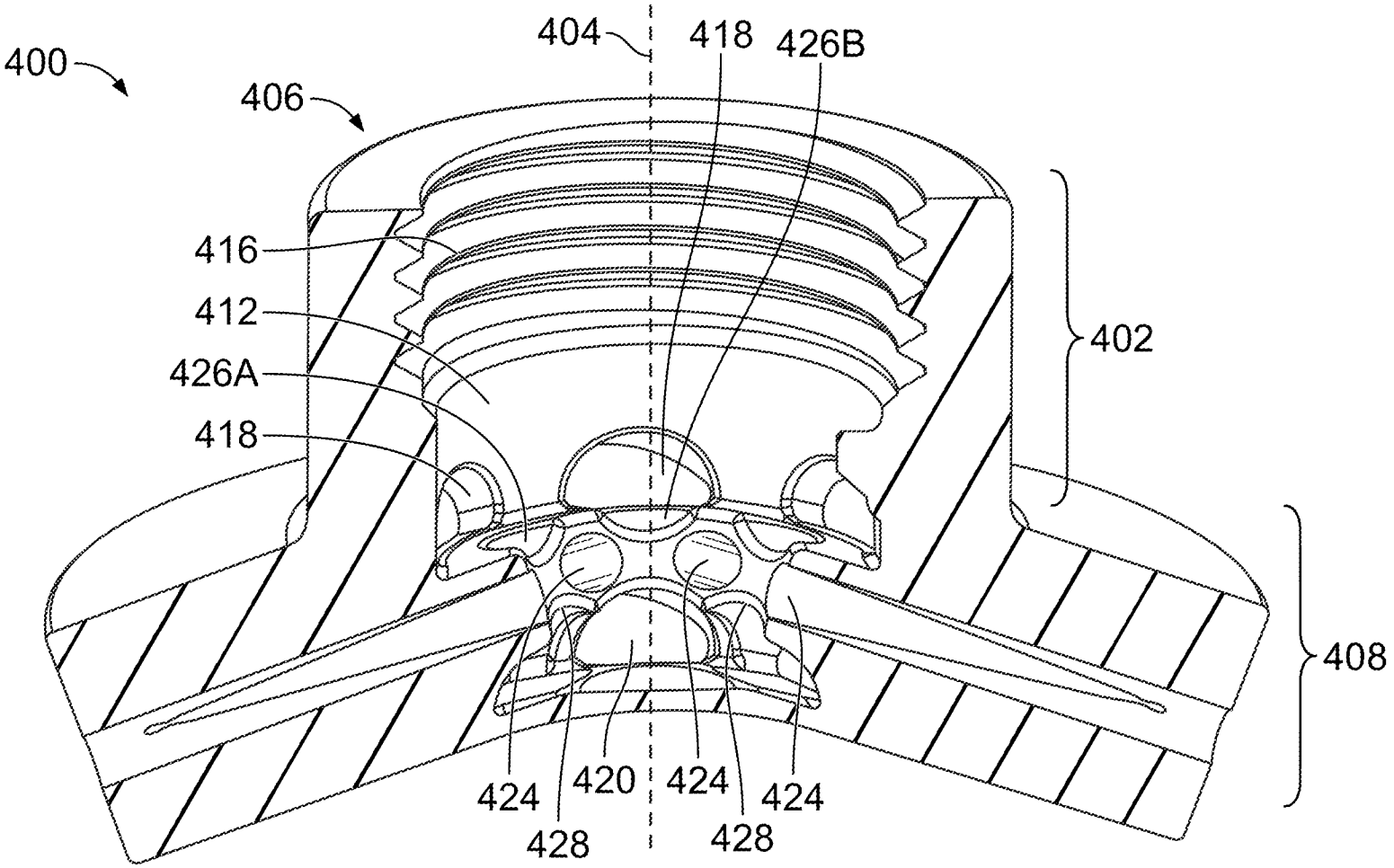
FIG. 4 illustrates a cross-sectional view of an insert device in accordance with one embodiment.

FIG. 4 illustrates an insert device 400 in accordance with one or more embodiments. The insert device includes a body 406 having an upper body portion 402 and a lower body portion 408 extending from the upper body portion along a center axis 404. The body includes an interior surface 412 that extends around a central volume of the body that is positioned to receive liquid fuel from the fuel injector. The insert device includes internal threads 416 that may be coupled with corresponding threads of a portion of the cylinder head to couple the upper body portion of the insert device with the cylinder head of the engine cylinder.

Like the insert device shown in FIG. 3, the insert device 400 includes gas inlet channels 418, 420 and fuel-and-gas mixture outlet channels 424. The fuel-and-gas mixture outlet channels are disposed between an upper set 418 of the gas inlet channels and a lower set 420 of the gas inlet channels along the center axis. The gas inlet channels are shaped, sized, and/or positioned to direct gas from a location outside of the insert device toward the central volume of the insert device to mix or combine with the liquid fuel. The fuel-and-gas mixture outlet channels are shaped, sized, and/or positioned to direct the fuel-and-gas mixture out of the central volume toward the combustion chamber of the engine cylinder.

In the illustrated embodiment, the insert device also includes concave surface portions disposed between the gas inlet channels and the fuel-and-gas mixture outlet channels along the center axis. For example, an upper set 426 of the concave surface portions are disposed above the fuel-and-gas mixture outlet channels, and a lower set 428 of the concave surface portions are disposed below the fuel-and-gas mixture outlet channels along the center axis. Unlike the insert device shown in FIG. 3, neighboring concave surface portions of the insert device 400 do not intersect each other. For example, a first concave portion 426A does not intersect or merge with a neighboring second concave portion 426B about the center axis. The first and second concave portions of the upper set are separated by a portion of the interior surface of the body.

Figure 5:
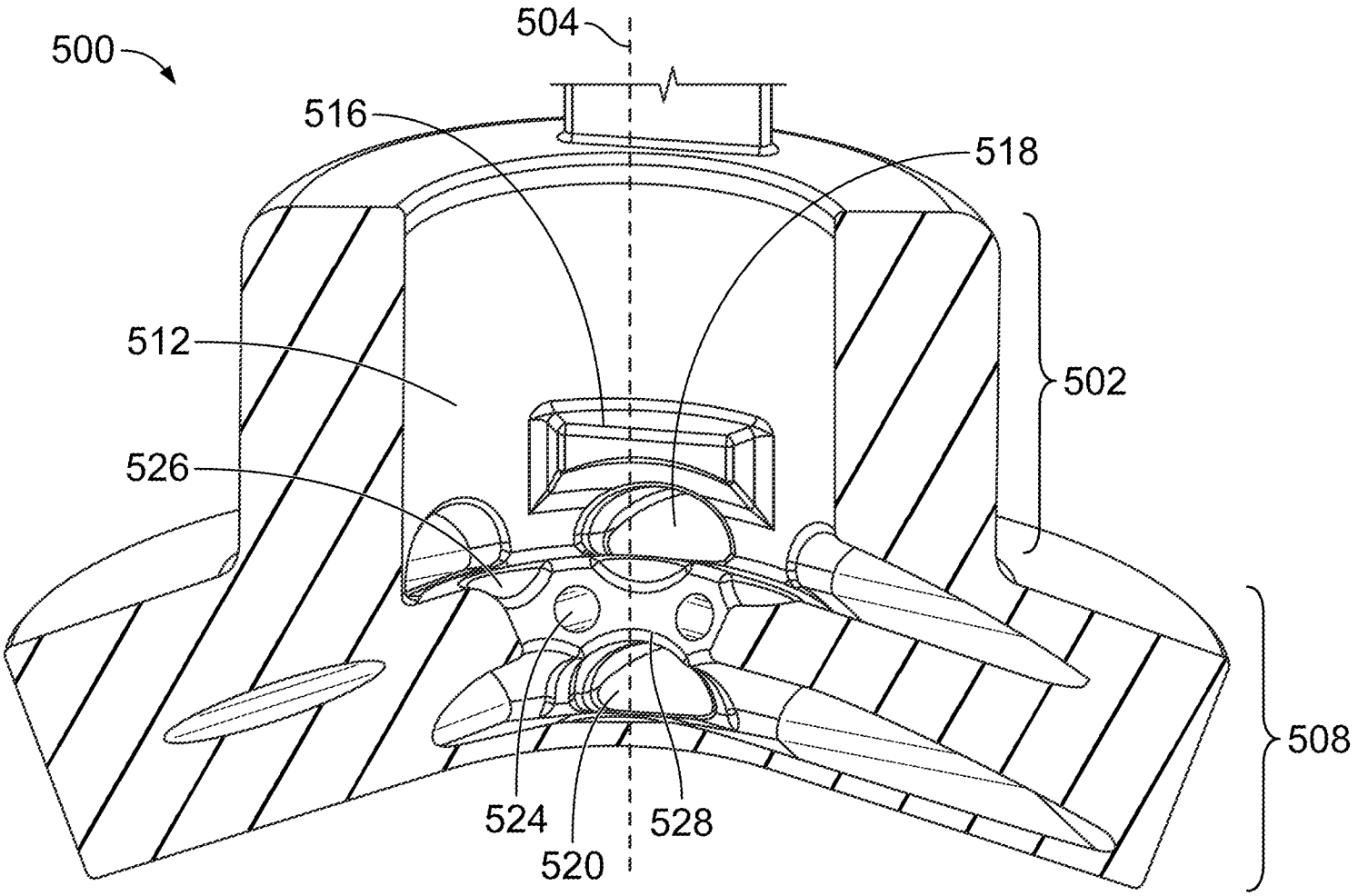
FIG. 5 illustrates a cross-sectional view of an insert device in accordance with one embodiment.

FIG. 5 illustrates an insert device 500 in accordance with one or more embodiments. The insert device includes an upper body portion 502 and a lower body portion 508 along a center axis 504. The device includes an interior surface 512 defining and extending around a central volume of the body. The upper body portion of the insert device includes a coupling feature 516 that may mate or couple with a corresponding coupling feature of the fuel injector and/or another portion of the cylinder head. In the illustrated embodiment, the coupling feature protrudes away from the interior surface of the body toward the center axis, but alternatively may extend into the interior surface and away from the center axis.

The insert device includes plural gas inlet channels 518, 520 disposed about the center axis. The gas inlet channels direct gas from a location outside of the insert device toward the central volume of the insert device. The device includes an upper set 518 of the gas inlet channels and a lower set 520 of the gas inlet channels. Plural fuel-and-gas mixture outlet channels 524 are disposed between the upper set and the lower set of the gas inlet channels along the center axis. The fuel-and-gas mixture outlet channels may be shaped, sized, and oriented to control one or more flow characteristics of the fuel-and-gas mixture that is directed out of the insert device via the outlet channels. For example, the fuel-and-gas mixture outlet channels shown in FIG. 5 have a cross-sectional size that is smaller than a cross-sectional size of the fuel-and-gas mixture outlet channels shown in FIG. 4. Optionally, one or more of the outlet channels may have a shape and/or size that is different than a shape and/or size of another outlet channel.

The insert device includes plural upper concave surface portions 526 and plural lower concave surface portions 528 that are shaped to direct the flow of gas into the central volume toward the liquid fuel in the central volume. In the illustrated embodiment of FIG. 5, neighboring concave surface portions of the upper set and the lower set do not intersect or merge with each other. Optionally, two neighboring concave portions may intersect with or merge with each other, and other neighboring concave portions may not intersect or merge with each other. Optionally, the body of the insert device may have an alternative arrangement of features (e.g., concave surfaces, recesses, protrusions, or the like) to control the flow of gas, the liquid fuel, and/or the fuel-and-gas mixture into the device, within the device, and/or out of the device.

Figure 6:
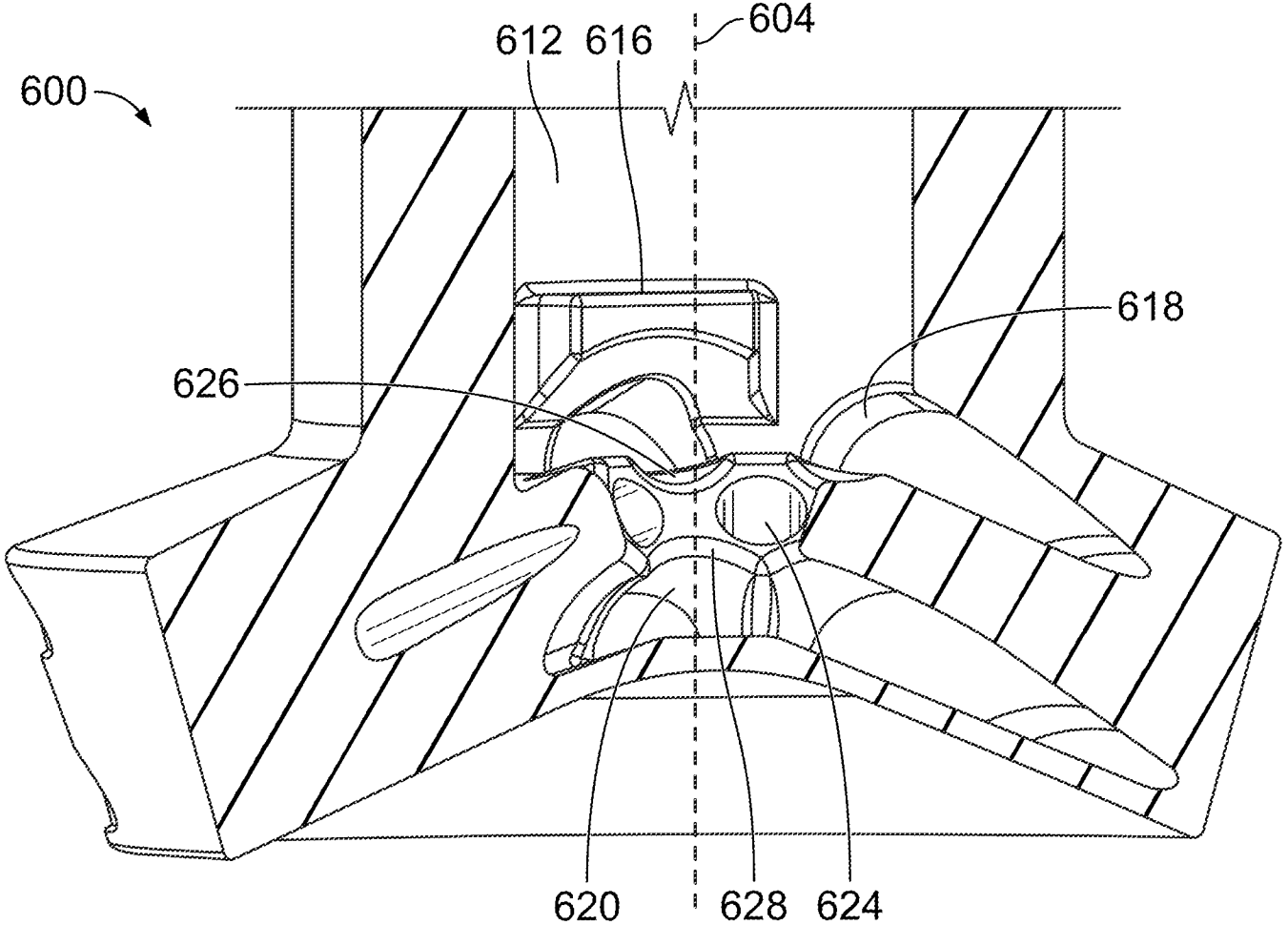
FIG. 6 illustrates a cross-sectional view of an insert device in accordance with one embodiment.

FIG. 6 illustrates an insert device 600 in accordance with one or more embodiments. The insert device includes a body having an interior surface 612 extending around and defining a central volume of the device. The device includes fuel-and-gas mixture outlet channels 624 disposed between plural upper gas inlet channels 618 and lower gas inlet channels 620 along a center axis 604 of the device. The gas inlet channels direct gas into the central volume of the device, and the fuel-and-gas mixture outlet channels direct a fuel-and-gas mixture out of the device toward the combustion chamber of the engine cylinder.

The interior surface of the insert device may include concave surface portions 626, 628 disposed at one or more locations along the center axis to control flow characteristics of the gas, the liquid fuel, and/or the fuel-and-gas mixture within the insert device. In one or more embodiments, the body of the insert device may be additively formed as a unitary structure, and one or more of the inlets, outlets, concave portions, or the like, may subsequently formed (e.g., drilled, machined, etched, or the like). For example, the insert device including the gas inlet channels, the concave surface portions, and a coupling feature 616 extending from the interior surface may be additively formed via plural layers of a material being coupled together, and the fuel-and-gas mixture outlet channels may be subsequently drilled, formed, or the like.

Figure 7:
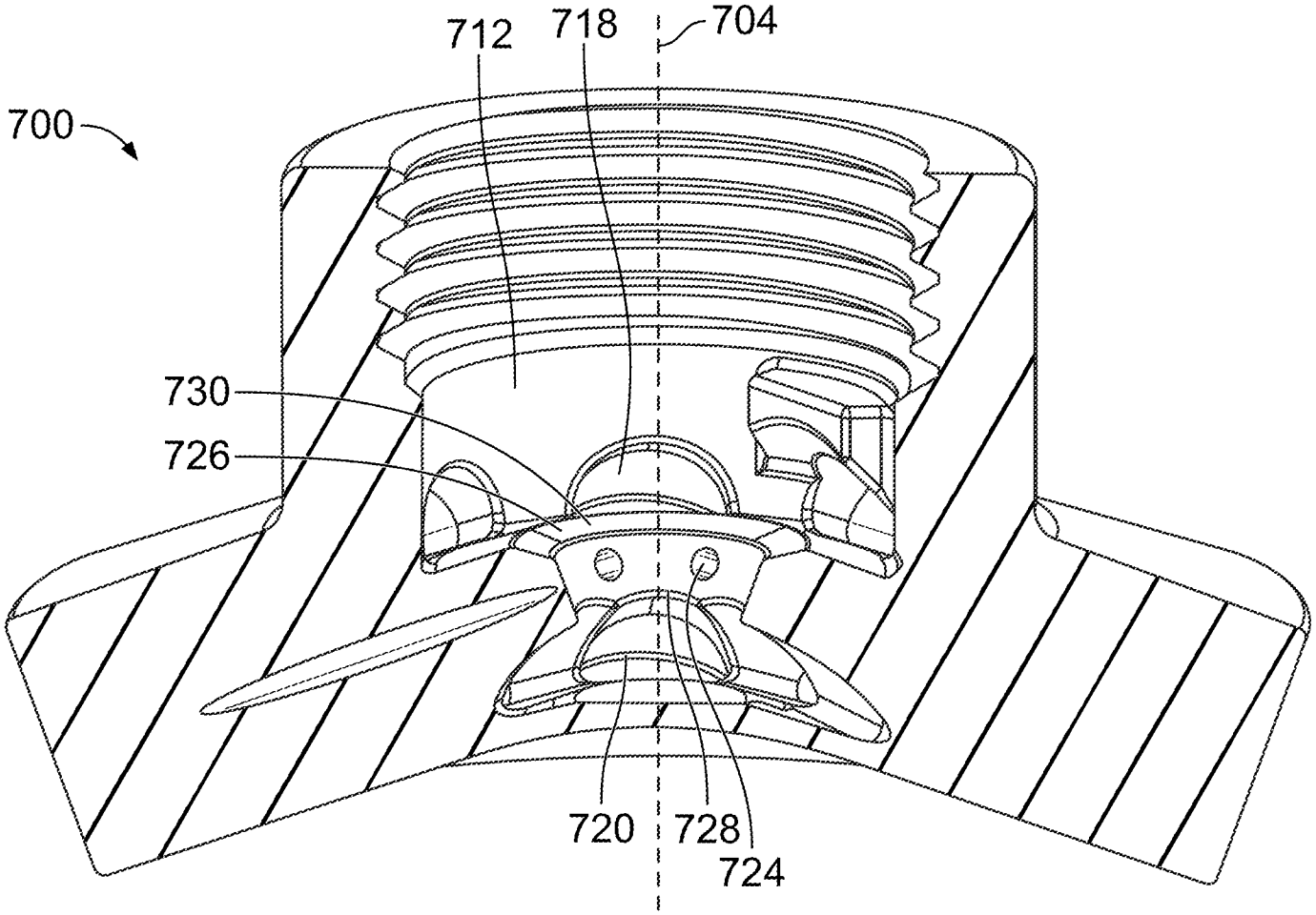
FIG. 7 illustrates a cross-sectional view of an insert device in accordance with one embodiment.

FIG. 7 illustrates an insert device 700 in accordance with one or more embodiments. The insert device includes a body having an interior surface 712 extending around and defining a central volume. The device includes fuel-and-gas mixture outlet channels 724 disposed between upper gas inlet channels 718 and lower gas inlet channels 720 along a center axis 704. The gas inlet channels direct gas into the central volume of the device where the gas mixed with liquid fuel from the fuel injector (not shown). The fuel-and-gas mixture outlet channels direct the fuel-and-gas mixture out of the device and toward the combustion chamber of the engine cylinder.

The insert device includes concave surface portions 728 that are disposed between the fuel-and-gas mixture outlet channels and the lower gas inlet channels. The concave surface portions direct the gas from the lower inlet gas channels within the device. Unlike the insert device shown in FIG. 3, the insert device does not include concave surface portions disposed between the upper gas inlet channels and the fuel-and-gas mixture outlet channels. Alternatively, the insert device includes an angled rim 726 encircling the center axis. The angled rim is disposed between the upper gas inlet channels and the fuel-and-gas mixture outlet channels. For example, the concave surface portions are disposed on a first side of the fuel-and-gas mixture outlet channels, and the angled rim is disposed on a second side of the fuel-and-gas mixture outlet channels that is opposite the first side.

The angled rim has an angled surface 730 oriented toward the fuel-and-gas mixture outlet channels. For example, the angled surface extends in a radial direction away from the center axis and is angled between the upper gas inlet channels and the fuel-and-gas mixture outlet channels. The angled rim may be referred to as a chamfered surface, chamfered feature, or the like. The angled surface is oriented to encourage the movement of gas from the upper gas inlet channels toward the central volume to mix or combine with the liquid-fuel.

Figure 8:
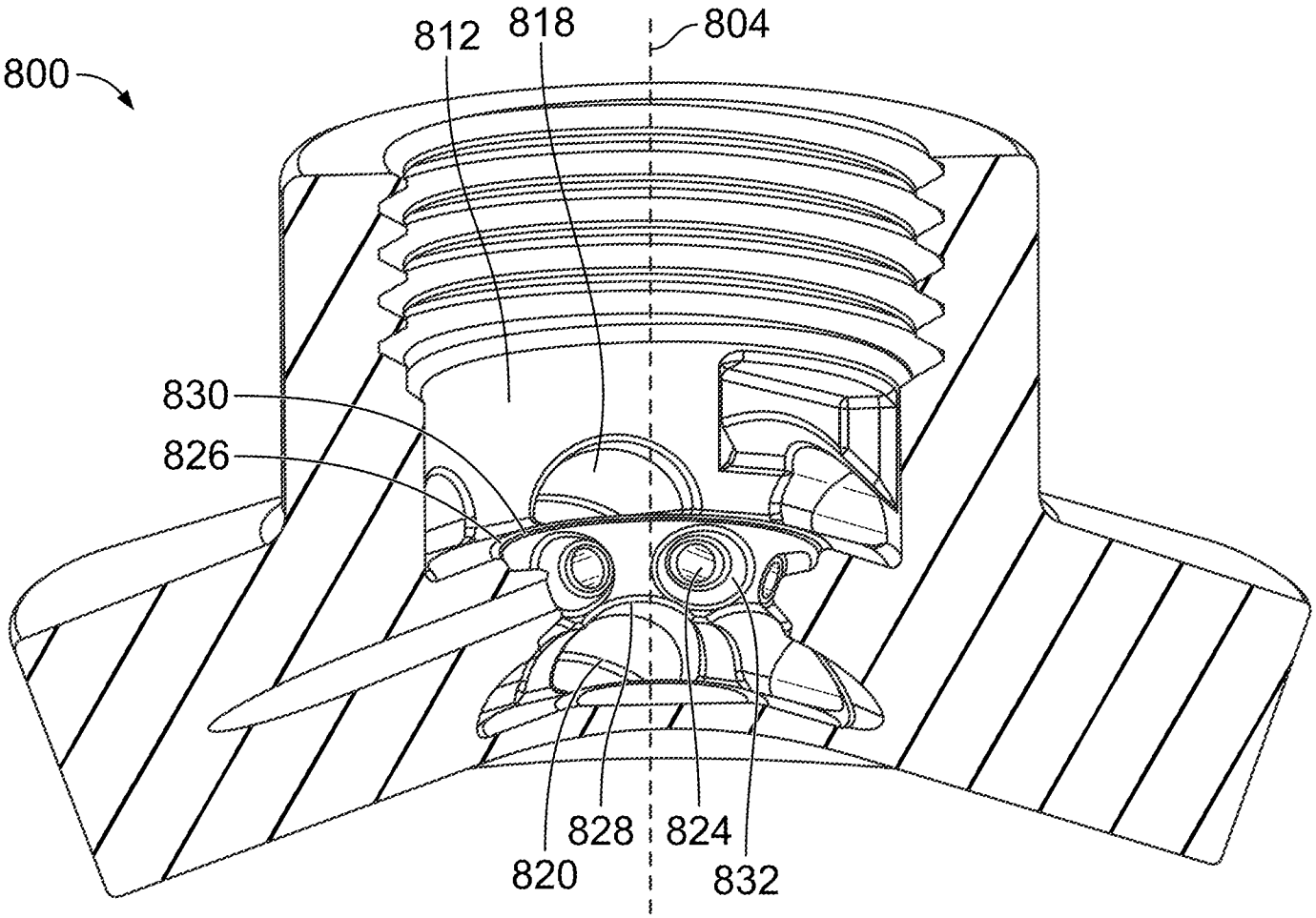
FIG. 8 illustrates a cross-sectional view of an insert device in accordance with one embodiment.

FIG. 8 illustrates an insert device 800 in accordance with one or more embodiments. Like the insert device shown in FIGS. 3 through 7, the insert device includes a body having an interior surface 812 defining a central volume of the device. The device includes fuel-and-gas mixture outlet channels 824 disposed between upper gas inlet channels 818 and lower gas inlet channels 820 along a center axis 804. The gas inlet channels direct gas into the central volume of the device where the gas mixed with liquid fuel from the fuel injector.

Like the insert device shown in FIG. 7, the insert device includes an angled rim 830 disposed on one side of the fuel-and-gas mixture outlet channels, and concave surface portions 828 disposed on an opposite other side of the fuel-and-gas mixture outlet channels. The interior surface of the insert device including the angled rim and the concave surface portions is configured to control one or more characteristics of the gas, the liquid-fuel, and/or the fuel-and-gas mixture.

The interior surface of the body includes inwardly protruding annular extensions 832 that extend from the interior surface toward the center axis of the insert device. In the illustrated embodiment, the inwardly protruding annular extensions are disposed or positioned around the fuel-and-gas mixture outlet channels. For example, the extensions may be coaxial with the fuel-and-gas mixture outlet channels. The extensions may be an extension of the fuel-and-gas mixture outlet channels that extends or protrudes into the central volume of the device. The extensions may extend around a portion of one or more of the fuel-and-gas mixture outlet channels to control one or more characteristics (e.g., pressure, volume, velocity or flow rate, direction, rotational forces, or the like) of the fuel-and-gas mixture directed out of the device via the fuel-and-gas mixture outlet channels. In one or more embodiments, one or more inwardly protruding extensions may be disposed around the upper and/or lower gas inlet channels, the fuel-and-gas mixture outlet channels, around one or more concave surface portions, or the like.

Figure 9:
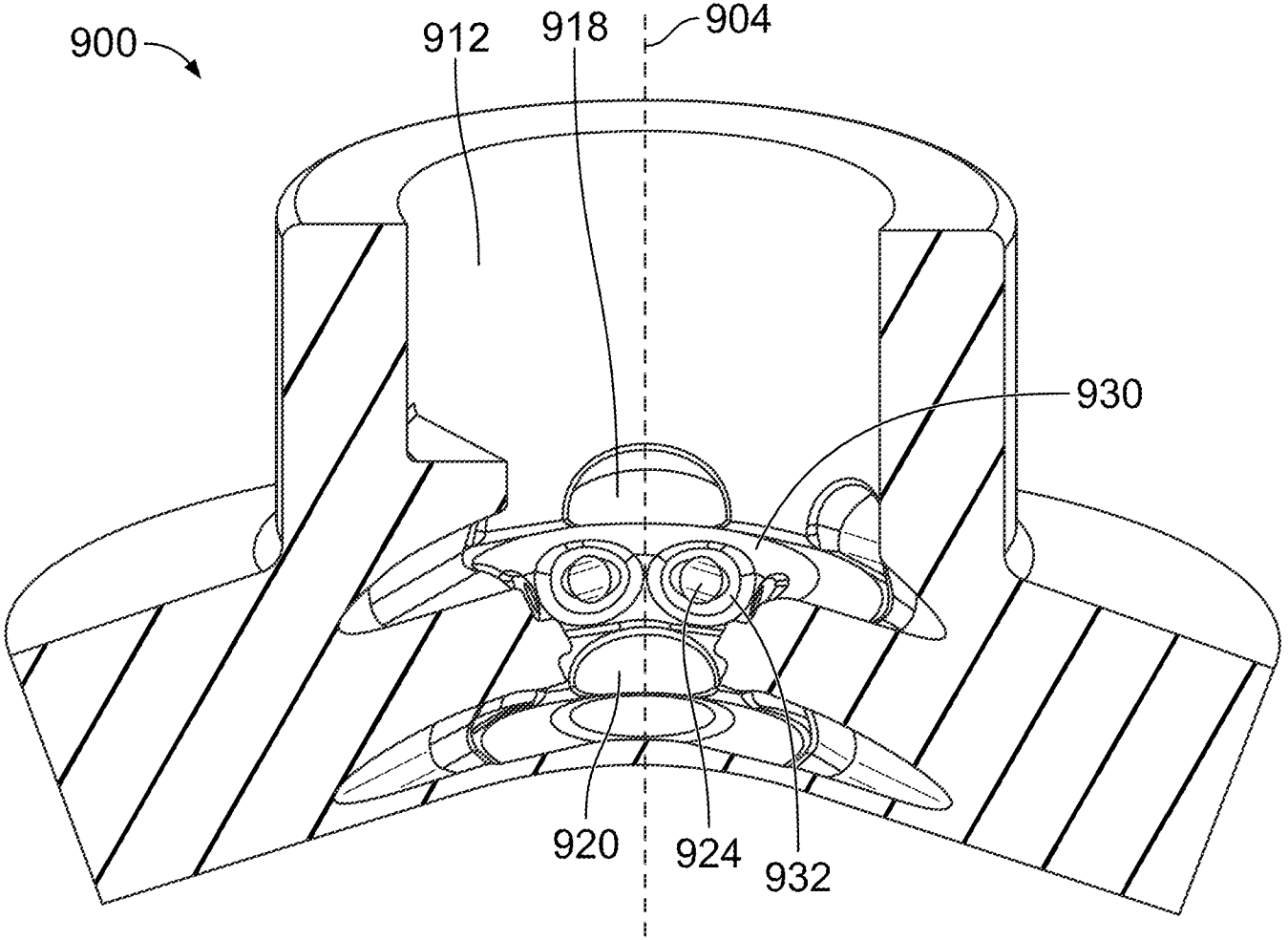
FIG. 9 illustrates a cross-sectional view of an insert device in accordance with one embodiment.

FIG. 9 illustrates an insert device 900 in accordance with one or more embodiments. The insert device includes an interior surface 912 that extends around a center axis 904 and defines a central volume of the device. The device includes fuel-and-gas mixture outlet channels 924 disposed between upper gas inlet channels 918 and lower gas inlet channels 920 along the center axis. The gas inlet channels direct gas into the central volume of the device where the gas mixed with liquid fuel from the fuel injector to form the fuel-and-gas mixture.

The insert device includes an angled rim 930 disposed between the upper gas inlet channels and the fuel-and-gas mixture outlet channels. In the illustrated embodiment, the angled rim includes a convex surface between the upper gas inlet channels and the fuel-and-gas mixture outlet channels. For example, the convex surface protrudes or extends away from the interior surface of device such that the interior surface includes a ridge, protrusion, hump, extension, or the like, between the gas inlet channels and the outlet channels. The angled rim is shaped to control one or more characteristics of the gas directed into the central volume via the gas inlet channels. In one or more embodiments, the insert device may include an angled rim disposed between the fuel-and-gas mixture outlet channels and the lower gas inlet channels.

Like the insert device shown in FIG. 8, the interior surface of the body includes inwardly protruding annular extensions 932 that extend from the interior surface toward the center axis of the device. The inwardly protruding annular extensions are positioned around the fuel-and-gas mixture outlet channels. Optionally, the extensions may be positioned around a portion of one or more of the fuel-and-gas mixture outlet channels, around a portion of one or more gas inlet channels, or the like.

FIG. 3 through 9 illustrate plural embodiments of insert devices having one or more different features. Optionally, the insert device may include one or more features from any of the different insert devices illustrated.

In one or more embodiments of the subject matter described herein, an insert device includes a body having an upper body portion configured to couple with a cylinder head of an engine cylinder and a lower body portion extending from the upper body portion toward a combustion chamber of the engine cylinder while the upper body portion is coupled with the cylinder head. The body includes an interior surface extending around a central volume positioned to receive liquid fuel from a fuel injector while the upper body portion is coupled with the cylinder head. The body includes gas inlet channels and fuel-and-gas mixture outlet channels. The gas inlet channels are positioned to receive gas from outside the body and direct the gas into the central volume where the gas mixes with the liquid fuel to form the fuel-and-gas mixture. The fuel-and-gas mixture outlet channels are positioned to direct the fuel-and-gas mixture into the combustion chamber of the engine cylinder while the upper body portion is coupled with the cylinder head. The interior surface of the body includes concave surface portions between the gas inlet channels and the fuel-and-gas mixture outlet channels along a center axis of the body. The concave surface portions are shaped to direct flow of the gas into the central volume toward the liquid fuel in the central volume.

Optionally, the upper body portion may include an upper end positioned to face away from the combustion chamber of the engine cylinder while the upper body portion is coupled with the cylinder head. The lower body portion may include an upper set of the gas inlet channels disposed between the upper end of the upper body portion and the fuel-and-gas mixture outlet channels, and a lower set of the gas inlet channels with the fuel-and-gas mixture outlet channels disposed between the upper and lower sets of the gas inlet channels.

Optionally, an upper set of the concave surface portions of the interior surface of the body may be positioned between the upper set of the gas inlet channels and the fuel-and-gas mixture outlet channels along the center axis of the body, and a lower set of the concave surface portions of the interior surface of the body may be positioned between the lower set of the gas inlet channels and the fuel-and-gas mixture outlet channels along the center axis of the body.

Optionally, the concave surface portions may include an intermediate set of the concave surface portions with each of the concave surface portions in the intermediate set located between neighboring channels of the fuel-and-gas mixture outlet channels.

Optionally, the concave surface portions may include one or both of an upper set or a lower set of the concave surface portions. The upper set of the concave surface portions may be disposed above the fuel-and-gas mixture outlet channels along the center axis, and the lower set of the concave surface portions may be disposed below the fuel-and-gas mixture outlet channels along the center axis. The concave surface portions in the intermediate set may merge with the one or both of the upper set of the lower set of the concave surface portions in locations between neighboring channels of the fuel-and-gas mixture outlet channels.

Optionally, neighboring concave surface portions may not intersect with each other.

Optionally, neighboring concave surface portions may intersect with each other.

Optionally, the interior surface of the body may include an angled rim encircling the center axis and have an angled surface oriented toward the fuel-and-gas mixture outlet channels.

Optionally, the concave surface portions may be disposed on a first side of the fuel-and-gas mixture outlet channels and the angled rim may be disposed on a second side of the fuel-and-gas mixture outlet channels that is opposite the first side.

Optionally, the interior surface of the body may include inwardly protruding annular extensions that are coaxial with the fuel-and-gas mixture outlet channels.

Optionally, the body may include plural layers of material coupled together to form the body.

In one or more embodiments of the subject matter described herein, an insert device includes a body having an upper body portion configured to couple with a cylinder head of an engine cylinder and a lower body portion extending from the upper body portion toward a combustion chamber of the engine cylinder while the upper body portion is coupled with the cylinder head. The body includes an interior surface extending around a central volume positioned to receive liquid fuel from a fuel injector while the upper body portion is coupled with the cylinder head. The body includes fuel-and-gas mixture outlet channels, an upper set of gas inlet channels, and a lower set of gas inlet channels. The upper and lower sets of the gas inlet channels are positioned to receive gas from outside the body and direct the gas into the central volume where the gas mixes with the liquid fuel to form a fuel-and-gas mixture. The fuel and gas mixture outlet channels are positioned to direct the fuel-and-gas mixture into the combustion chamber of the engine cylinder while the upper body portion is coupled with the cylinder head. The interior surface of the body includes concave dimples between the fuel-and-gas mixture outlet channels and one or more of the upper set or lower set of the gas inlet channels. The concave dimples are shaped to direct flow of the gas into the central volume toward the liquid fuel in the central volume.

Optionally, the concave dimples may include an intermediate set of the concave dimples with each of the concave dimples in the intermediate set located between neighboring channels of the fuel-and-gas mixture outlet channels.

Optionally, an upper set of the concave dimples may be disposed above the fuel-and-gas mixture outlet channels along the center axis, and a lower set of the concave dimples may be disposed below the fuel-and-gas mixture outlet channels along the center axis. The concave dimples in the intermediate set may merge with the one or both of the upper set or the lower set of the concave dimples in locations between neighboring channels of the fuel-and-gas mixture outlet channels.

Optionally, neighboring concave dimples may not intersect with each other.

Optionally, neighboring concave dimples may intersect with each other.

Optionally, the interior surface of the body may include an angled rim encircling the center axis and include an angled surface oriented toward the fuel-and-gas mixture outlet channels.

Optionally, the concave dimples may be disposed on a first side of the fuel-and-gas mixture outlet channels and the angled rim may be disposed on a second side of the fuel-and-gas mixture outlet channels that is opposite the first side.

Optionally, the interior surface of the body may include inwardly protruding annular extensions that are coaxial with the fuel-and-gas mixture outlet channels.

In one or more embodiments of the subject matter described herein, a method includes depositing a first layer onto a build surface, and sequentially depositing one or more additional layers upon the first layer to form an additively manufactured body having an upper body portion configured to couple with a cylinder head of an engine cylinder and a lower body portion extending from the upper body portion toward a combustion chamber of the engine cylinder while the upper body portion is coupled with the cylinder head. The body is formed to have an interior surface extending around a central volume positioned to receive liquid fuel from a fuel injector while the upper body portion is coupled with the cylinder head. The body is formed to have gas inlet channels and fuel-and-gas mixture outlet channels. The gas inlet channels are positioned to receive gas from outside the body and direct the gas into the central volume where the gas mixed with the liquid fuel to form a fuel-and-gas mixture. The fuel-and-gas mixture outlet channels are positioned to direct the fuel-and-gas mixture into the combustion chamber of the engine cylinder while the upper body portion is coupled with the cylinder head. The interior surface of the body is formed to have concave surface portions between the gas inlet channels and the fuel-and-gas mixture outlet channels along a center axis of the body. The concave surface portions are shaped to direct flow of the gas into the central volume toward the liquid fuel in the central volume.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An insert device comprising:

a body having an upper body portion configured to couple with a cylinder head of an engine cylinder and a lower body portion extending from the upper body portion toward a combustion chamber of the engine cylinder while the upper body portion is coupled with the cylinder head, the body having an interior surface extending around a central volume positioned to receive liquid fuel from a fuel injector while the upper body portion is coupled with the cylinder head, the body including upper and lower sets of gas inlet channels with fuel-and-gas mixture outlet channels located between the upper and lower sets of the gas inlet channels, the upper and lower sets of the gas inlet channels positioned to receive gas from outside of the body and direct the gas into the central volume where the gas mixes with the liquid fuel to form a fuel-and-gas mixture, the fuel-and-gas mixture outlet channels positioned to direct the fuel-and-gas mixture into the combustion chamber of the engine cylinder while the upper body portion is coupled with the cylinder head, the interior surface of the body having upper and lower sets of concave surface portions with the upper set of the concave surface portions including two or more of the concave surface portions located between the upper set of the gas inlet channels and the fuel-and-gas mixture outlet channels along a center axis of the body, the lower set of the concave surface portions including two or more of the concave surface portions located between the fuel-and-gas mixture outlet channels and the lower set of the gas inlet channels along the center axis of the body, the upper and lower sets of the concave surface portions shaped to direct flow of the gas into the central volume toward the liquid fuel in the central volume.

2. The insert device of claim 1, further comprising an intermediate set of two or more of the concave surface portions with each of the concave surface portions in the intermediate set located between neighboring channels of the fuel-and-gas mixture outlet channels.

3. The insert device of claim 2, wherein the concave surface portions in the intermediate set merge with one or both of the upper set or the lower set of the concave surface portions in locations between neighboring channels of the fuel-and-gas mixture outlet channels.

4. The insert device of claim 2, wherein the concave surface portions in the intermediate set are located between the upper set of the concave surface portions and the lower set of the concave surface portions.

5. The insert device of claim 1, wherein the concave surface portions do not merge or couple with each other.

6. The insert device of claim 1, wherein the concave surface portions merge or couple with each other.

7. The insert device of claim 1, wherein the interior surface of the body includes inwardly protruding annular extensions that are coaxial with the fuel-and-gas mixture outlet channels.

8. The insert device of claim 1, wherein the body includes plural layers of material coupled together to form the body.

9. The insert device of claim 1, further comprising a coupling feature that protrudes from the interior surface toward a center axis of the body, the coupling feature configured to mate with the fuel injector or the cylinder head.

10. An insert device comprising:

a body having an interior surface extending around a central volume positioned to receive liquid fuel from a fuel injector while an upper body portion of the body is coupled with a cylinder head of an engine cylinder, the body including fuel-and-gas mixture outlet channels, an upper set of gas inlet channels, and a lower set of the gas inlet channels, the upper and lower sets of the gas inlet channels positioned to receive gas from outside of the body and direct the gas into the central volume where the gas mixes with the liquid fuel to form a fuel-and-gas mixture, the fuel-and-gas mixture outlet channels positioned to direct the fuel-and-gas mixture into a combustion chamber of the engine cylinder while the upper body portion is coupled with the cylinder head, the interior surface of the body having upper and lower sets of concave dimples, wherein the upper set of the concave dimples are located between the fuel-and-gas mixture outlet channels and the upper set of the gas inlet channels along a center axis of the body, and the lower set of the concave dimples are located between the fuel-and-gas mixture outlet channels and the lower set of the gas inlet channels along the center axis of the body, the upper and lower sets of the concave dimples shaped to direct flow of the gas into the central volume toward the liquid fuel in the central volume.

11. The insert device of claim 10, wherein the concave dimples include an intermediate set of the concave dimples with each of the concave dimples in the intermediate set located between neighboring channels of the fuel-and-gas mixture outlet channels and located between the upper set and the lower set of the gas inlet channels.

12. The insert device of claim 11, wherein portions of the concave dimples in the intermediate set merge with portions of one or both of the upper set or the lower set of the concave dimples in locations between neighboring channels of the fuel-and-gas mixture outlet channels.

13. The insert device of claim 10, wherein a portion of a first concave dimple of the upper set of concave dimples does not merge or couple with a portion of a neighboring concave dimple of the upper set of concave dimples.

14. The insert device of claim 10, wherein a portion of a first concave dimple of the upper set of concave dimples merges with a portion of a neighboring concave dimple of the upper set of concave dimples.

15. The insert device of claim 10, wherein the interior surface of the body includes inwardly protruding annular extensions that are coaxial with the fuel-and-gas mixture outlet channels.

16. The insert device of claim 10, further comprising a coupling feature that protrudes from the interior surface toward a center axis of the body, the coupling feature configured to mate with the fuel injector or the cylinder head.

17. A method comprising:

depositing a first layer onto a build surface; and sequentially depositing one or more additional layers upon the first layer to form an additively manufactured body having an upper body portion configured to couple with a cylinder head of an engine cylinder and a lower body portion extending from the upper body portion toward a combustion chamber of the engine cylinder while the upper body portion is coupled with the cylinder head, the body formed to have an interior surface extending around a central volume positioned to receive liquid fuel from a fuel injector while the upper body portion is coupled with the cylinder head, the body formed to have upper and lower sets of gas inlet channels with fuel-and-gas mixture outlet channels located between the upper and lower sets of the gas inlet channels, the upper and lower sets of the gas inlet channels positioned to receive gas from outside of the body and direct the gas into the central volume where the gas mixes with the liquid fuel to form a fuel-and-gas mixture, the fuel-and-gas mixture outlet channels positioned to direct the fuel-and-gas mixture into the combustion chamber of the engine cylinder while the upper body portion is coupled with the cylinder head, the interior surface of the body formed to have upper and lower sets of concave surface portions with the upper set of the concave surface portions including two or more of the concave surface portions located between the upper set of the gas inlet channels and the fuel-and-gas mixture outlet channels along a center axis of the body, the lower set of the concave surface portions including two or more of the concave surface portions located between the fuel-and-gas mixture outlet channels and the lower set of the gas inlet channels along the center axis, the upper and lower sets of the concave surface portions shaped to direct flow of the gas into the central volume toward the liquid fuel in the central volume.

* * * * *